United States Patent [19]

Johnson

[11] 4,292,906

[45] Oct. 6, 1981

[54] ROTATABLE LOOP TAKER AND BOBBIN CASE ASSEMBLY

[75] Inventor: Ralph E. Johnson, Convent Station, N.J.

[73] Assignee: The Singer Company, Stamford, Conn.

[21] Appl. No.: 102,075

[22] Filed: Dec. 10, 1979

[51] Int. Cl.[3] ..... D05B 57/14; D05B 57/26

[52] U.S. Cl. ..... 112/184; 112/231

[58] Field of Search ..... 112/181, 184, 191, 228, 112/230, 231

[56] References Cited

U.S. PATENT DOCUMENTS 266,977 11/1882 Darling ..... 112/191

2,900,940 8/1959 Johnson ..... 112/184

4,121,527 10/1978 Johnson ..... 112/184 X

*Primary Examiner*—Wm. Carter Reynolds

*Attorney, Agent, or Firm*—William V. Ebs; Robert E. Smith; Edward L. Bell

[57] ABSTRACT

A lockstitch sewing machine is provided with a rotatable loop and bobbin case assembly providing for limited contact between the loop taker and bobbin case, and including a bracket which is affixed to the bed of the machine and is connected with the bobbin case at substantially diametrically opposite locations thereon to constrain the bobbin case angularly and rotationally but permit needle thread to be moved by the loop taker between the bobbin case and bracket during the formation of lockstitches.

9 Claims, 10 Drawing Figures

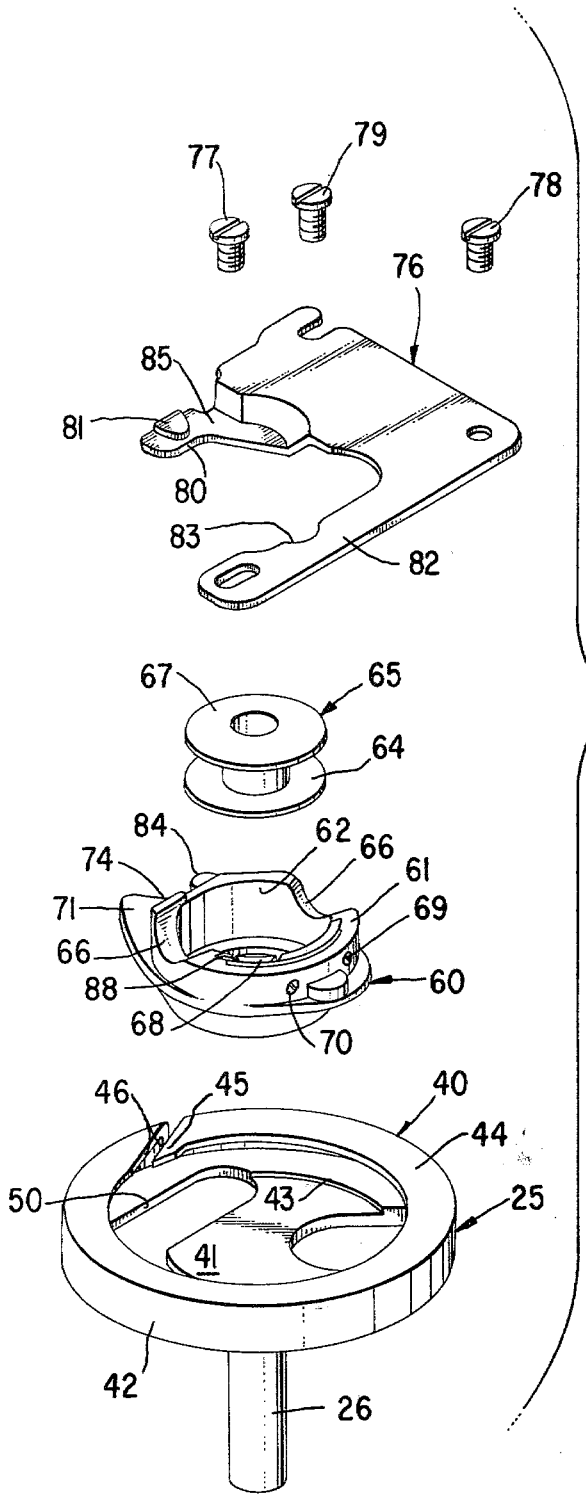
Fig. 1.
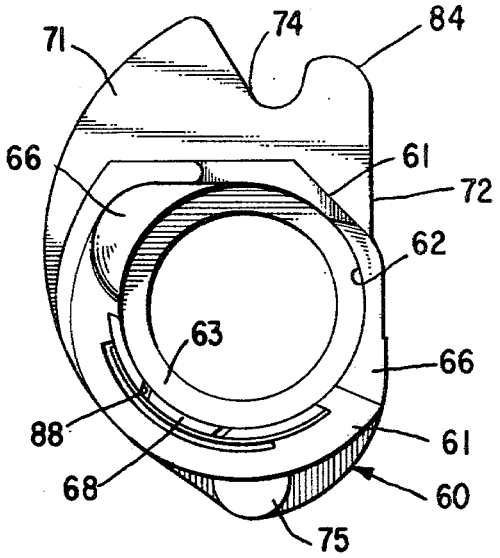
Fig. 2.
Fig. 3.
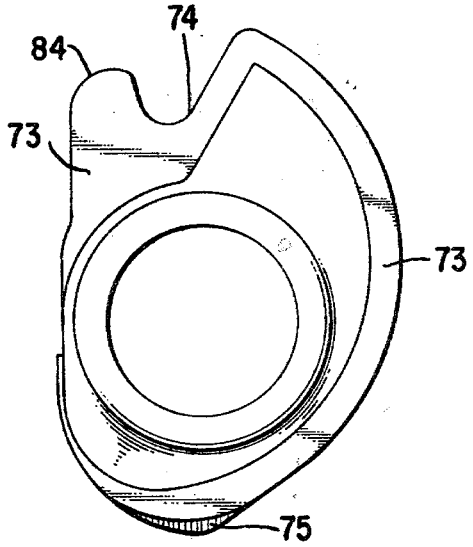

ROTATABLE LOOP TAKER AND BOBBIN CASE ASSEMBLY

BACKGROUND OF THE INVENTION

1. Field of the Invention

The invention is directed to a rotatable loop taker and bobbin case assembly for use in a lockstitch sewing machine.

2. Description of the Prior Art

It is known to support a bobbin case on a bearing surface of a rotatable vertical axis loop taker in a lockstitch sewing machine, and to loosely constrain the bobbin case angularly, rotationally and axially within the loop taker with a bracket which is secured in the bed of the machine. However, the prior constructions, of which the construction disclosed in U.S. Pat. No. 3,373,707 for "Loop Taker for Sewing Machines" issued Mar. 19, 1968 to S. J. Ketterer and assigned to The Singer Company is an example, have not proved to be entirely satisfactory because of excessive friction between the rotating hook and bobbin case resulting in undue noise, and because the thread at cast-off had to pull clear of the loop taker and into a slot in the bracket by a thread takeup with considerable force which caused the thread to be pulled from a previous stitch and resulted in irregularities in stitches formed on the machine.

SUMMARY OF THE INVENTION

In accordance with the invention, a bobbin case, disposed within the loop taker of a lockstitch sewing machine, is vertically supported at a location on the arm of a bracket affixed in the bed of the machine and is supported at another location on a bearing surface of the loop taker. The bobbin case is slightly tilted by the bracket arm and thereby caused to contact only a very short length of the bearing surface of the loop taker. As a consequence of such limited contact very little friction develops between the bobbin case and loop taker during rotation of the loop taker. The bobbin case is constrained both rotationally and angularly within the loop taker by a semicircular projecting tab on the bracket loosely received in a recess in the bobbin case, and by a semicircular tab on the bobbin case located substantially diametrically opposite the bobbin case recess and loosely received in a recess in the bracket. The bobbin case tab is so located as to enable the loop taker beak to move needle thread about the tab to a position where the thread can be pulled by the takeup with the application of little tension to the thread.

DESCRIPTION OF THE DRAWINGS

FIG. 1 is an exploded perspective view of the loop taker, bobbin case, bobbin, and bobbin case constraining bracket of a preferred embodiment of the invention;

FIG. 2 is a top plan view of the bobbin case;

FIG. 3 is a bottom plan view of the bobbin case;

FIGS. 4, 5 and 6 illustrate a portion of a sewing machine frame 11 in which the loop taker of this invention is carried. As illustrated the sewing machine frame is preferably formed with an upwardly open compartment 12 for the loop taker, which compartment is formed with an upper shelf 13 which accommodates a slide cover plate 14 and a throat plate (not shown). The compartment 12 is also formed with an intermediate shelf 15 and with a bottom wall 16 formed with a boss 17 adapted to provide the support for the loop taker.

The compartment 12, in addition to accommodating the loop taker of this invention, may also accommodate a feed dog 18 of a conventional drop mechanism which may be opposed by a conventional presser foot 19 as illustrated in FIG. 5. FIG. 5 also illustrates a fragment of a thread carrying needle 20 which together with the presser foot may be supported in another portion of the sewing machine frame (not illustrated), and to which needle endwise reciprocatory motion may be imparted in the conventional fashion.

Figure 4:
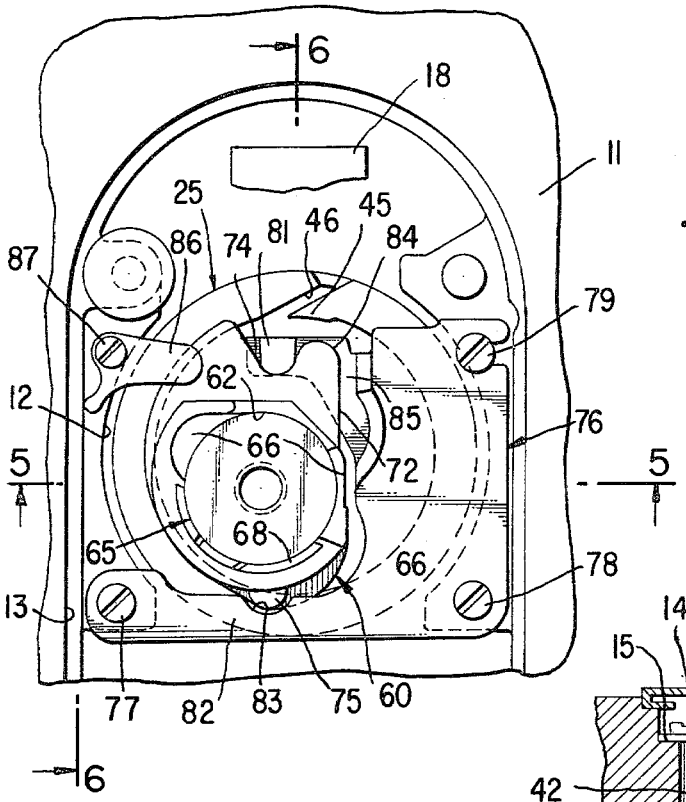
FIG. 4 is a fragmentary top plan view showing the loop taker and associated parts in a sewing machine with the slide cover and throat plates removed.
Figure 5:
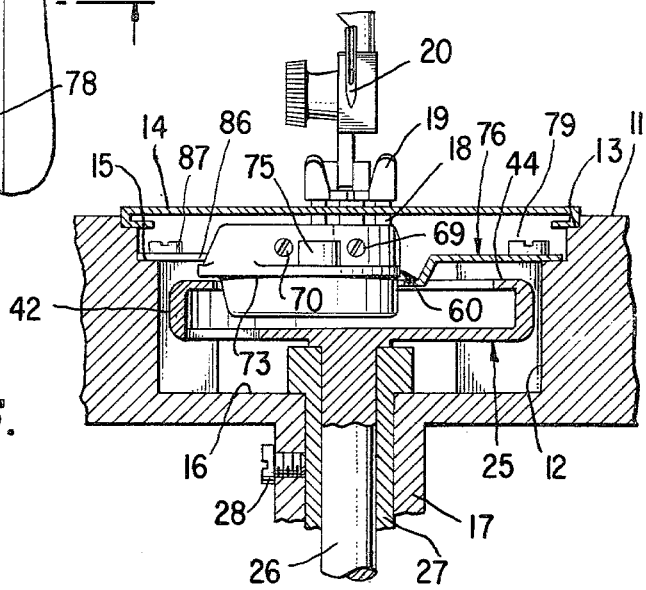
FIG. 5 is a fragmentary vertical sectional view taken through the machine substantially on the plane of the line 5—5 of FIG. 4.
Figure 6:
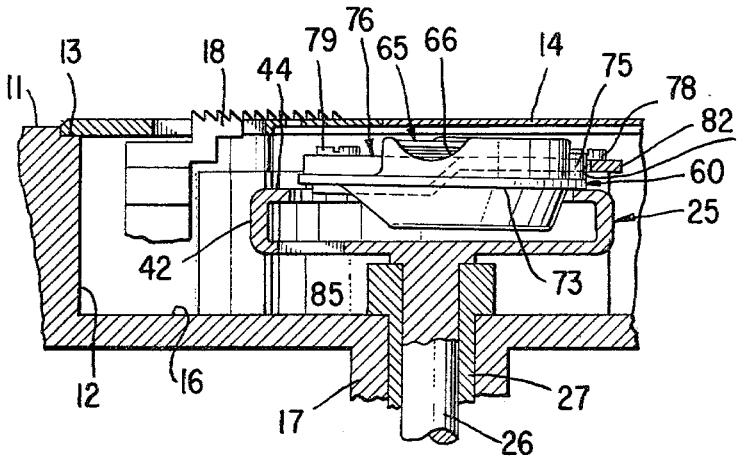
FIG. 6 is a fragmentary vertical sectional view taken through the machine substantially on the plane of the line 6—6 of FIG. 4.

The loop taker, which is indicated generally as 25 in the drawings, includes a loop taker shaft 26 which is journaled in a bushing 27 secured by a set screw 28 in the boss 17 of the sewing machine frame compartment 12. Rotary movement of the loop taker shaft and reciprocation of the needle, in timed relation to each other is provided for with conventional mechanism (not shown). Such mechanism is preferably adapted to impart two revolutions to the loop taker for each reciprocation of the needle.

As illustrated in FIG. 1, secured to or forming an integral part of the upper extremity of the loop taker shaft 26 is the loop taker body 40 which is generally cup-shaped and includes a flat bottom wall 41 and a cylindrical side wall 42 encompassing an upwardly open cavity 43. The rim 44 of the loop taker body is formed as a planar bearing surface disposed in a plane perpendicular to the axis of the loop taker shaft 26 so as to provide a bearing surface for the bobbin case as will be described hereinbelow. The cylindrical side wall 42 of the loop taker body is formed with an inwardly directed needle loop engaging beak 45 which is defined by a vertical slot 46 formed in the side wall 42 and rim 44. The bottom wall 41 of the loop taker body is formed with an needle accommodating clearance slot 50 extending on that side of the loop taker body which is occupied by the loop seizing beak 45.

The bobbin case, which is indicated generally as 60, includes a generally cylindrical central portion 61 formed with a cylindrical bobbin accommodating cavity 62 which is upwardly open and formed at the bottom with a radially inwardly extending ledge 63 adapted to engage and support the bottom flange 64 of a conventional flanged bobbin 65. The cylindrical central portion 61 of the bobbin case may be formed with one or more shallow rim indentations 66 providing space for an operator's finger tips to grip the upper flange 67 of the bobbin in order that bobbins may be replaced or exchanged easily. A conventional bobbin thread tensioning spring 68 is secured by a fastening screw 69 on the inner surface of the central cylindrical portion of the bobbin case. An adjusting screw 70 provides for adjustment of the tension applied by the spring 68 upon the bobbin thread.

The bobbin case 60 includes a flange 71 extending radially outward from the central portion 61 of the bobbin case and perpendicular to the axis of portion 61. As shown, the flange is mostly curvilinear but includes a slabbed edge 72. The flange 71 has a planar undersurface 73 and includes a semicircular notch 74. The bobbin case also includes a tab 75 located substantially opposite the notch. The tab may be an integral part of the bobbin case or a separate piece affixed with adhesive or in any other suitable manner to the central portion 61 and flange 71 of the bobbin case.

A bobbin case restraining bracket generally indicated as 76 is secured by screws 77, 78 and 79 to the intermediate shelf 15 in the loop taker compartment 12 of the sewing machine frame. The bracket includes a short arm 80 with a top projecting tab 81 which extends just forwardly of the line of reciprocation of the sewing needle 20 into bobbin case notch 74 where it is loosely received. The bracket further includes a second arm 82 which is parallel to arm 80 and includes a semicircular recess 83 wherein bobbin case tab 75 is loosely received. The bobbin case 60 is vertically supported at a corner 84 near notch 74 on bracket surface 85, and is also vertically supported by engagement of the rim 44 of the loop taker with a portion of undersurface 73 the bobbin case flange 71. Bracket surface 85 is at a level slightly higher than loop taker rim 44 and tilts the bobbin case 60 upwardly at corner 84 relative to the loop taker to limit engagement of the loop taker rim 44 with the bobbin case to a small arc on the bobbin case flange substantially diametrically opposite the corner 84.

Bracket projection 81 extending into bobbin case notch 74, and the bobbin case tab 75 extending into circular recess 83 in bracket 76 constrain the bobbin case both rotationally and radially. A dog 86 removably secured to shelf 15 by a screw 87 and extending over flange 71 is provided to constrain the bobbin case axially. The bobbin case constraining parts are constructed to provide sufficient clearance for the passage of needle thread between the bobbin case and dog 86 as well as between tab 75 on the bobbin case and bracket arm 82 as the needle thread is moved by the loop taker 25 about the bobbin case during operation of the sewing machine.

Figure 7:
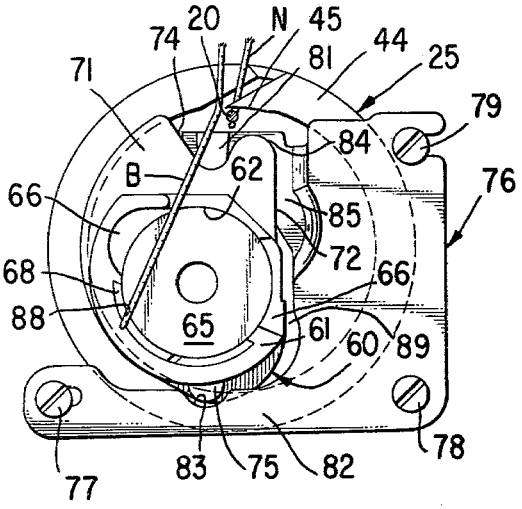
FIG. 7 is a top plan view of the loop taker and associated parts, and includes a representation of the sewing thread as the needle thread loop is seized by the loop taker.

The manner in which sewing threads are manipulated in the assembly of the invention of the loop taker to provide for the formation of lockstitches may be readily seen in FIGS. 7, 8, 9 and 10. FIG. 7 illustrates the position of the loop taker and threads at the moment the loop taker beak 45 seizes a loop of thread from the needle. In the drawing, the needle thread is indicated as N and the bobbin thread as B. The bobbin thread B during sewing extends from the thread guiding notch 88 in the bobbin across the top of the bobbin and bobbin case and thence to the stitches being formed in the work.

Figure 8:
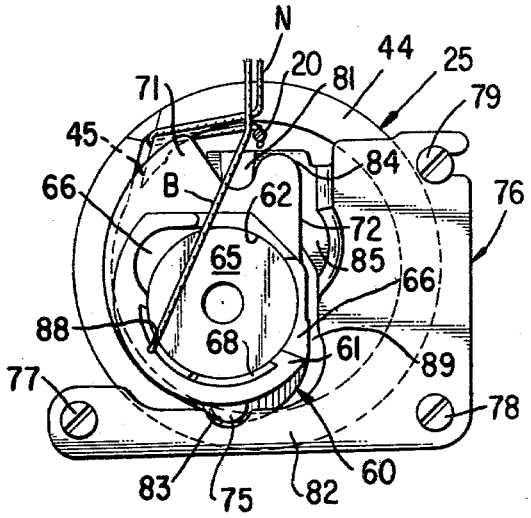
FIG. 8 is a top plan view similar to FIG. 7 illustrating the position of the sewing thread as the needle thread loop is carried initially toward the bobbin case.

FIG. 8 illustrates the position of parts of the loop taker shortly after needle loop seizure by the beak 45 and at a point in which the seized needle thread loop is about to be spread about the bobbin case bearing flange 71. The needle thread loop as shown in FIG. 8 extends to the end of slot 46 radially outward of the hook beak, and that limb of the seized needle thread loop which is above the rim 44 of the loop taker body is directed to move over the bobbin case flange, while that limb of the seized needle thread loop which is below the hook beak is directed to move beneath the bobbin case flange.

Figure 9:
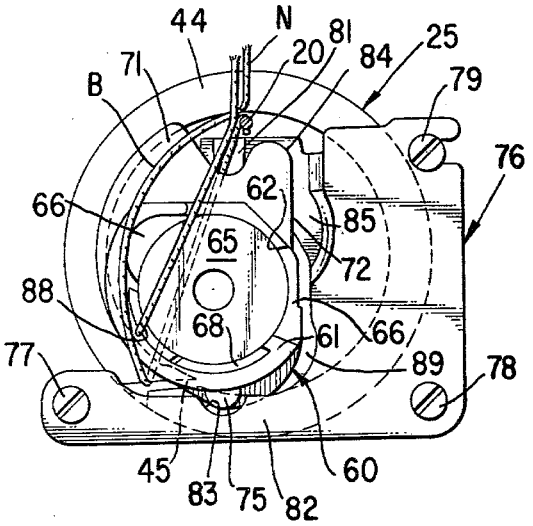
FIG. 9 is a top plan view similar to FIG. 7 but illustrating the position of the sewing thread as the loop taker beak carries the needle thread loop about the bobbin case.

As illustrated in FIG. 9, rotation of loop taker 25 has progressed beyond that illustrated in FIG. 8 to a point where the needle thread loop still caught in the end of slot 46 is close to bobbin tab 75. The upper and lower limbs of the needle thread loop have been moved to positions as indicated above and below the bobbin case. With continued rotation of the loop taker, the needle thread loop is carried about bobbin tab 75 in a clearance between the tab and bracket arm 82.

Figure 10:
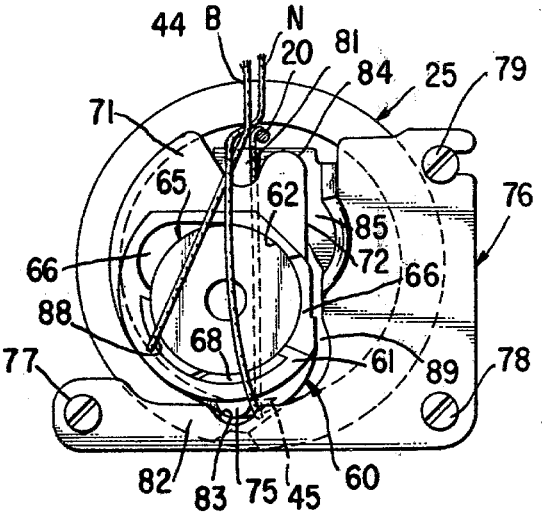
FIG. 10 is a view similar to FIG. 7 illustrating the position of the sewing thread at cast-off

In FIG. 10, the needle thread has been moved past tab 75 by the loop taker which is shown therein in the position at which the needle loop is being shed from the beak 45. After the needle loop is shed by the loop taker beak 45 the needle thread is pulled by a takeup (not shown) through a clearance 89 between the bracket and bobbin case, as well as off the bobbin case. With continued pull by the takeup the needle thread N is tightened about the bobbin thread B and drawn up into a stitch in material being sewn.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications, and alterations which do not depart from the spirit and scope of the invention are intended to be included within the scope of the appended claims.

What is claimed is:

1. In a lockstitch sewing machine, a work supporting bed, a loop taker mounted for rotation about a vertical axis in the bed and including a rim with a beak for seizing thread carried by a reciprocating needle, a bobbin case within the loop taker, a bracket affixed in the bed and loosely connected to the bobbin case to constrain the bobbin case rotationally and radially and permit the passage of said thread between the bobbin case and bracket during the formation of the lockstitches on the machine, the bobbin case being vertically supported at one location on the bracket and at another location on the rim of the loop taker, the bobbin case being tilted relative to the loop taker by the bracket to limit the area of contact between the bobbin case and looptaker rim.

2. The combination of claim 1 wherein the locations at which the bobbin case is vertically supported are substantially diametrically across the bobbin case from each other.

3. The combination of claim 1 wherein the bracket is connected to the bobbin case in close proximity to the path of reciprocation of the needle and at another location through which the needle thread may be moved by the loop taker.

4. The combination of claim 1 wherein the connection between the bobbin case and bracket includes a tab and a receiving recess at one location around the bobbin case, and another tab and another receiving recess at another location around the bobbin case.

5. The combination of claim 4 wherein said bobbin case locations are substantially diametrically across the bobbin case from each other.

6. The combination of claim 4 wherein the recesses are substantially semicircular.

7. The combination of claim 6 wherein the tabs are substantially semicircular.

8. The combination of claim 4 wherein said bobbin case locations are substantially diametrically across the bobbin case from each other and both the tabs and recesses are substantially semicircular.

9. The combination of claim 1 wherein the bobbin case includes a flange and the bobbin case is vertically supported on said flange at the said one and another location.

* * * * *